United States Patent [19]

Gusman et al.

[11] 3,930,749

[45] Jan. 6, 1976

[54] TURBODRILL

[76] Inventors: Moisei Timofeevich Gusman, Vorobievskoe shosse, 11, kv. 69; Boris Georgievich Ljubimov, 5 Parkovaya ulitsa, 48, korpus 14, kv. 7; Igor Leonidovich Konstantinov, Nagornaya ulitsa, 16, korpus 1, kv. 53; Irina Ivanovna Kuznetsova, Kremlevskaya naberezhnaya, 1/9, kv. 34; Boris Davidovich Malkin, ulitsa Vavilova, 54, korpus 1, kv. 38; Gely Meierovich Nikitin, Kerchenskaya ulitsa, 2/35, kv. 147, all of Moscow, U.S.S.R.

[22] Filed: Dec. 12, 1974

[21] Appl. No.: 531,968

[52] U.S. Cl. ..... 415/199 R; 415/502

[51] Int. Cl.[2] ..... F03B 13/02

[58] Field of Search..... 415/191, 192, 194, 199 R, 415/219 R, 502

[56] References Cited

UNITED STATES PATENTS

| | | | |
|---|---|---|---|
| 1,482,702 | 2/1924 | Scharpenberg | 415/199 R |
| 2,306,583 | 12/1942 | Yost | 415/502 |
| 2,340,738 | 2/1944 | Dilley | 415/199 R |
| 2,353,534 | 7/1944 | Yost | 415/502 |
| 3,356,338 | 12/1967 | Ioanesyan et al. | 415/502 |
| 3,405,912 | 10/1968 | Lari et al. | 415/502 |
| 3,598,187 | 8/1971 | Mothre | 415/502 |
| 3,728,040 | 4/1973 | Ioanesian et al. | 415/502 |
| 3,754,835 | 8/1973 | Ivanov et al. | 415/502 |

*Primary Examiner*—Henry F. Raduazo
*Attorney, Agent, or Firm*—Holman & Stern

[57] ABSTRACT

A turbodrill comprises a housing in which there are fixed stators having blades forming a circular pattern and defining guide passages for the flow of drilling fluid fed by mud pumps, and a shaft mounted on a thrust bearing and having rotors fixed thereto, the blades of the rotors also forming a circular pattern and having the direction opposite to the stator blades so that the rotor rotates relative to the stator. The rotor and stator blades are shaped such a manner that an angle $\theta$ between the tangents to the middle line of the profile at the inlet and outlet edges of the blade determining the profile camber is selected in accordance with the relationship $\theta = 180° - (\text{from } 4.5 \text{ to } 7)\alpha_1$, an angle $\alpha_2$ between the line perpendicular to the axis of the pattern and the tangent to the middle line of the profile at the outlet edge of the blade is selected in accordance with the relationship $\alpha_2 = (\text{from } 3.5 \text{ to } 6)\alpha_1$, wherein $\alpha_1$ is an angle between the line perpendicular to the axis of the pattern and the tangent to the middle line of the profile at the inlet edge thereof as measured in the direction towards the concave portion of the profile, and the ratio of maximum thickness "Δ" of the blade profile to the chord "1" thereof is selected within the range $\delta/1 = \text{from } 0.09 \text{ to } 0.19$.

3 Claims, 7 Drawing Figures

TURBODRILL

BACKGROUND OF THE INVENTION

This invention relates to hydraulic bottom-hole motors for drilling wells for the purposes of prospecting for and production of oil, gas and other mineral resources, and more specifically to turbodrills for drilling wells, preferably with the employment of diamond bits.

At present diamond bits are being widely employed, and they are efficient with rotational speeds exceeding the values generally used for rotary bits.

Known in the art is a turbodrill for drilling wells comprising a housing with stators fixed therein having blades forming a circular pattern and defining guide passages for the flow of drilling fluid, which is fed by means of mud pumps, and a shaft mounted in the housing by means of an axial support having rotors fixed thereto, the blades of the rotors forming a circular pattern and being directed oppositely to the stator blades so as to change the direction of flow of drilling fluid, the stator and rotor blades being mounted in a manner such as to form the turbodrill turbine stages in which the linear motion of drilling fluid transformed into the rotary motion of the rotors, and means for fixing the turbine stages to the shaft and housing, respectively.

During the operation of the above-described turbodrill with diamond bits, the shaft rotates at high speeds as compared to those used for conventional turbodrills. Since the rotational speed of turbodrills cannot be controlled, the incidence angle of flow at the blades may vary over a wide range during the drilling to attain its maximum in the zone of extreme operating conditions (breaking or idling). The flow through the blade patterns occurs with the angles of attack which are larger than those inherent in conventional turbodrills thus resulting in considerable energy losses. In practice, this brings about a large growth of the pressure difference in the turbodrill during the braking when using a turbine having slightly cambered blades or during the idling when using a turbine having strongly cambered blades. Such an abrupt change in the pressure difference in a turbodrill causes heavy problems in operation (frequent damages to the protective diaphragms of pumps and the like). In addition, strongly cambered blades have a relatively low efficiency.

When using patterns with axial entrance of the flow and blades with relatively thin inlet edges, the flow is separated from the blade surfaces, and a considerable growth of the pressure difference occurs during the braking, which also makes the operation of a turbodrill difficult. With thickened inlet edges of the blades, this effect is reduced, but in this case, a considerable reduction of the turbodrill efficiency occurs due to increased profile energy losses, thereby impairing the power characteristics, and primarily, the torque value. It is this value that determines the load taken by the turbodrill, that is the opportunity of attaining necessary drilling conditions, with other conditions being equal.

The attempts to use a known turbodrill for diamond drilling were ineffective either due to an abrupt growth of the pressure difference in the delivery line of the pump unit during the braking of the turbodrill shaft, or due to a low efficiency of the motor impairing its torque response.

In known constructions of turbodrills, the thrust bearing can be also used as a seal to limit the leakage of drilling fluid at the turbodrill shaft outlet. Since in this case, the main flow of drilling fluid through the passages of a coupling member or through the passages of the shaft is directed to the central passage of the shaft, a low velocity zone is formed in the space between the shaft and housing, wherein the thrust bearing is accommodated. As a result, the heaviest fractions may be precipitate from the drilling fluid to penetrate into the bearing assembly. The absence of any protection of the turbodrill bearing against penetration of coarse abrasive particles results in premature wear. A failure of the turbodrill support will require premature pulling of the bit out of the hole. In case of using diamond bits, every additional pulling of the bit results in losses of diamonds, whereby the service life of the bit is shortened, thus reducing the efficiency of drilling. For that reason, the problem of increasing the bearing life is of prime importance for turbodrills used with diamond bits.

The disadvantages of known turbodrills also include complicated and unreliable fastening of parts to the shafts.

SUMMARY OF THE INVENTION

It is an object of the invention to provide a turbodrill having a high efficiency. Another object of the invention is to provide a turbodrill exhibiting a pressure difference varying over the range providing for normal operation thereof.

Still another object of the invention is to provide a turbodrill having a prolonged service life of the bearing assembly.

The invention may be used either in turbodrills having the thrust bearing accommodated in one of the turbodrill sections, or in turbodrills with the thrust bearing forming an independent assembly spindle, or in turbodrills of other types. The invention will be described herein with reference to the spindle-type construction of turbodrill.

These and others objects are accomplished by the provision of a turbodrill for drilling wells comprising a housing with stators fixed therein having blades forming a circular pattern and defining guide passages for the flow of positively fed drilling fluid, and a shaft mounted in the housing on a thrust bearing having rotors fixed thereto, the rotor blades forming a circular pattern and having the direction opposite to that of the stator blades to thereby change the direction of flow of drilling fluid, the stator and rotor blades being mounted in a manner such as to form stages of the turbodrill turbine in which the linear motion of the drilling fluid is transformed into the rotary motion of the rotors, and means for fixing the turbine stages to the shaft and housing, respectively, wherein, according to the invention, the the blades of the stator and rotor are shaped in such a manner that an angle ($\theta$) between the tangents to the middle line of the profile of the blades at the inlet and outlet edges of the blades is determined by the relationship $\theta = 180° -$ (from 4.5 to 7) $\alpha_1$, wherein $\alpha_1$ is an angle between the line perpendicular to the axis of the pattern and the tangent to the middle line of the profile of the blades at the inlet edge thereof as measured in the direction towards the concave portion of the blade profile, an angle ($\Delta_2$) between the line perpendicular to the axis of the pattern and the tangent to the middle line of the blade profile at the outlet edge thereof is determined by the relationship $\alpha_2 =$ (from 3.5 to 6)$\alpha_1$, and the ratio of maximum thickness ("δ") of the blade profile to the chord ("1") thereof is selected within the range $\delta/1$ = from 0.09 to 0.19.

The geometrical proportioning of the blade profile according to the invention is the optimum one to obtain, on the one hand, the elimination of the possibility of any considerable growth of the pressure difference during the braking of the turbodrill, and on the other hand, the achievement of the improved efficiency of turbine under operating conditions.

The invention provides a turbodrill having improved efficiency, increased torque, limited change in the pressure difference upon changes in the operating conditions, and prolonged service life of the thrust bearing.

BRIEF DESCRIPTION OF THE DRAWING

The invention will now be described with reference to a specific embodiment thereof illustrated in the accompanying drawings, in which.

DETAILED DESCRIPTION OF PREFERRED EMBODIMENTS

Figure 1:
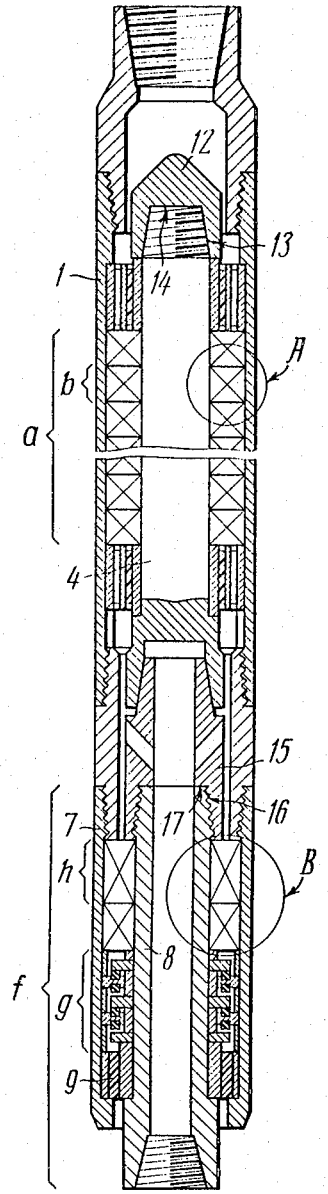
FIG. 1 schematically shows a longitudinal section of a turbodrill according to the invention.
Figure 2:
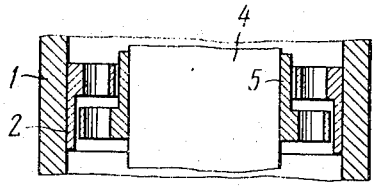
FIG. 2 is a detail A in FIG. 1 (a turbine stage in section)

A turbodrill shown in FIGS. 1 to 4, its top portion to be coupled with the lower end of the drilling string for receiving drilling fluid positively fed therethrough, comprises a turbine "*a*" consisting of stages "*b*", each having a stator 2 fixed in a housing 1 and provided with vanes 3, and a rotor 5 with blades 6 fixed to the shaft 4.

The stator blades 3 form a circular pattern "*c*" and define guide passages "*d*" through which there flows the drilling fluid. The blades 3 are shaped in such a manner that an angle $\theta$ between the tangents to the middle line of the profile at the inlet and outlet edges of the blade is selected in accordance with the relationship; $\theta = 180° -$ (from 4.5 to 7)$\alpha_1$, and an angle ($\alpha_2$) between the line perpendicular to the axis 0–0, axis O–O being perpendicular to the vertical axis of the housing, of the pattern "*c*" and the tangent of the middle line of the profile at the outlet edge of the blade is selected in accordance with the relationship; $\alpha_2$ = (from 3.5 to 6)$\alpha_1$, wherein $\alpha_1$ is an angle between the line perpendicular to the axis 0–0 of the pattern "*c*" and the tangent to the middle line of the profile at the inlet edge of the blade as measured in the direction of the concave portion of the blade profile. The ratio of maximum thickness "δ" of the profile, as measured normally to the generatrix line thereof to the chord "1", is selected within the range $\delta/1$ = from 0.09 to 0.19.

The blades 6 of the rotor 5 also form a circular pattern "*e*", are made with the following geometrical proportioning: $\theta = 180° -$ (from 4.5 to 7)$\alpha_1$, $\alpha_2$ = (from 3.5 to 6)$\alpha_1$ and $\delta/1$ = from 0.9 to 0.19, and directed oppositely with respect to the blades 3 of the stator 2 so as to change the direction of flow of the drilling fluid, whereby the rotor 5 rotates relative to the stator 2 to transmit torque to the shaft 4.

The blades 3 of the stator 2 and the blades 6 of the rotor 5 form the stages "*b*" of the turbodrill turbine "*a*", in which the linear motion of the drilling fluid is transformed into the rotary motion of the rotors.

Figure 4:
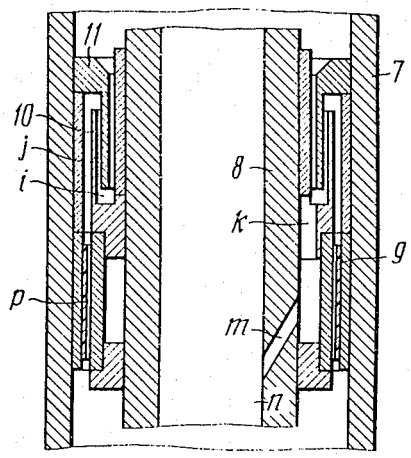
FIG. 4 is a detail B in FIG. 1 (longitudinal section of the cage)

In the bottom part of the turbodrill there is fixed to the housing 1 thereof a spindle "*f*", including a casing 7 and a spindle shaft 8 connectible to a rock-desintegrating tool, and a thrust bearing "*g*" and radial bearings 9, of which one only is shown in FIG. 4, are located between the casing and shaft.

The top portion of the spindle incorporates a cage "*h*" comprising shouldered busings 10 and 11. The bushing 10 is rigidly fixed to the shaft to define an annular space "*i*" accommodating, with a gap "*j*", a part of the bush 11 which is rigidly fixed in the casing. The above-mentioned annular space "*i*" communicates with a central passage "n" of the spindle shaft via passages "*k*" of the bush 10 and a passage "*m*" of the shaft 8 of the spindle.

The fastening of parts to the shaft 4 is effected by means of a coupling member 12 with a taper thread 13 having an internal bearing end face 14, and the fastening to the spindle shaft 8 is made by means of a coupling member 15 of the spindle and a taper thread 16 of the spindle shaft having internal bearing end face 17.

Figure 5:
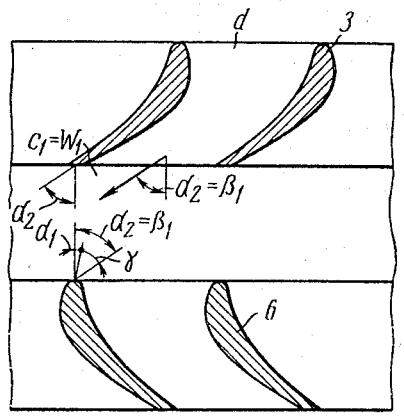
FIG. 5 is a developed view in the plane of section along the circumference of the stator and rotor blades and the direction of flow velocities under the braking conditions.

With the braked shaft of the turbodrill, the drilling fluid leaving the passages "*d*" (FIG. 5) of the stator is admitted to the rotor blades 6 at an angle $\beta_1 = \alpha_2$ (the equality of angles $\beta_1$ and $\alpha_2$ is due to the fact that with the stationary rotor, absolute velocity $c_1$ and relative velocity $w_1$ of the liquid entering the rotor blades are equal). This incidence angle of the liquid corresponds to the angle of attack $\gamma = \beta_1 - \alpha_1 = \alpha_2 - \alpha_1$, or, taking into account the relationship $\alpha_2$ = (from 3.5 to 6)$\alpha_1$ limiting the value of angle of attack under the braking conditions, $\gamma$ = (from 0.71 to 0.83)$\alpha_2$.

This limitation considerably reduces the possibility of growth of the pressure difference in the turbodrill during the braking as compared to the pressure difference under the operating conditions which corresponds to one half of the rotational speed under the idling conditions. In this case the growth of pressure difference will not substantially exceed 20%.

Figure 6:
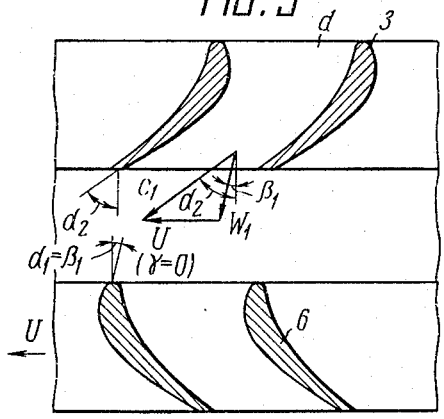
FIG. 6 is a developed view in the plane of section along the circumference of the stator and rotor blades and the direction of flow velocities under the rated operating conditions.
Figure 7:
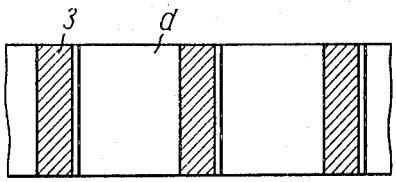
FIG. 7 is a sectional view taken along the line VII—VII in FIG. 3.

As the rotational speed "*u*" of the rotor 5 (FIG. 2) increases (FIG. 6), and the operating conditions approach to the rated ones; the liquid leaving the passages "*d*" of the stator is admitted to the rotor blades 6 in the course of the relative motion at an angle $\beta_1$ which is different from the angle $\alpha_2$ determining the direction of flow of the liquid in the course of absolute motion. Thus, neither the directions, nor values of velocities $c_1$ and $w_1$ are not identical in this case.

Figure 3:
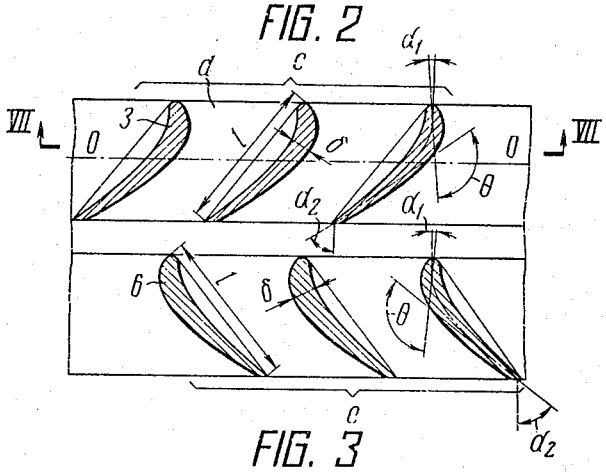
FIG. 3 is a developed view in the plane of section along the circumference of stator and rotor blades of the turbine stage.

While gaining the rated operating conditions, the values of angles $\beta_1$ and $\gamma$ decreases, so that under the rated operating conditions $\beta_1 = \alpha_1$ and $\gamma = 0$. With the angle of attack $\gamma = 0$ the flow of fluid around the blades takes place substantially without a surging shock, whereby the pressure difference due to the shock losses also decreases. Since such losses under the rated operating conditions are negligible, the value of power losses is mainly determined by the amount of camber of the blade profile, which is given by the angle $\theta$ (FIG. 3)

and relative thickness $\delta/1$.

The relationship $\theta = 180° - (\text{from } 4.5 \text{ to } 7)\alpha_1$, taking into account the relationship $\alpha = (\text{from } 3.5 \text{ to } 6)\alpha_1$, may be expressed in the form $\theta = 180° - (\text{from } 1.17 \text{ to } 1.29)\alpha_2$, from which it follows that the camber of the blade profile is limited with perdetermined values of $\alpha_2$. The relative thickness of the profile is limited by the relationship $\delta/1 = \text{from } 0.09 \text{ to } 0.19$. Such a relatively small thickness of the profile results in a reduced resistance to the flow of liquid through the blade patterns, due to a decrease in energy losses for flowing through the blade patterns. Therefore, the camber of profile and the relative thickness thereof are substantially limited by the above-specified relationships so that an elevated efficiency can be attained under the rated operating conditions.

The drilling fluid is directed from the turbine into the spindle "*f*" having the cage "*h*" located in the top portion thereof above the thrust bearing "*g*". At the abrupt turn of the flow, upon passing through the annular space "*i*", the heaviest fractions of drilling fluid precipitate in this space enter the central passage "*n*" of the spindle shaft via the passages "*k*" and "*m*", while the cleaned drilling fluid is fed into the thrust bearing "*g*" of the turbodrill through a gap "*p*" of the radial bearing 9.

The fastening of the stages "*b*" of the turbine "*a*" as well as of the parts of the thrust bearing "*g*" and radial bearing 9, to the shaft 4 by means of the coupling member 12 with the taper thread 13 and with the internal bearing end face 14, permits the simplification of the structure and improves the reliability of the assembly for fastening parts to the spindle.

What is claimed is:

1. A turbodrill for drilling wells having a top portion for coupling with the bottom end of the drilling string for receiving drilling fluid which is positively fed therethrough and a bottom portion provided with a coupling member for a rock-disintegrating tool, said turbodrill comprising: a housing; stators fixed in said housing; said stators having blades arranged to form a circular patterns and to define guide passages for the flow of drilling fluid positively fed through the drilling string; a shaft having a central passage accommodated in said housing; bearing means mounted in said housing for rotation of said shaft relative to said housing and for transmitting the load from the drilling string to the rock-disintegrating tool; rotors fixed to said shaft, said rotors having blades arranged to form a circular pattern, said blades being directed oppositely relative to said stator blades and mounted in a manner such that said stator and rotor blades form turbodrill turbine stages in which the linear motion of the drilling fluid is transformed into the rotary motion of said rotors; means for fixing said stators and rotors of the turbine stages to said shaft and housing, respectively; the blades of said rotor and stator being shaped in such a manner that an angle ($\theta$) between tangents to a middle line of the profile of said blades at the inlet and outlet edges of said blades is determined by the relationshihp $\theta = 180° - (\text{from } 4.5 \text{ to } 7)\alpha_1$, wherein $\alpha_1$ is an angle between a line perpendicular to an axis of said blade patterns and the tangent to the middle line of the profile of said blades at the inlet edge thereof as measured in the direction towards the concave portion of the blade profile, and angle ($\alpha_2$) between the line perpendicular to the axis of said blade patterns and the tangent to the middle line of said blades at the outlet edge thereof is determined by the relationship $\alpha_2 = (\text{from } 3.5 \text{ to } 6)\alpha_1$, and a ratio of maximum thickness ("$\delta$") of the profile of said blades to the chord ("1") thereof is selected within the range $\delta/1 = \text{from } 0.09 \text{ to } 0.19$.

2. A turbodrill for drilling wells having a top portion for coupling with the bottom end of the drilling string for receiving drilling fluid which is positively fed therethrough, and a bottom portion provided with a coupling member for a rock-disintegrating tool, said turbodrill comprising: a housing; stators fixed in said housing, said stators having blades arranged to form a circular pattern and to define guide passages for the flow of drilling fluid positively fed through the drilling string; a shaft having a central passage accommodated in said housing; bearing means mounted in said housing for rotation of said shaft relative to said housing and for transmitting the load from the drilling string to the rock-disintegrating tool; rotors fixed to said shaft, said rotors having blades arranged to form a circular pattern, said blades being directed oppositely relative to said stator blades and mounted in such a manner that said stator and rotor blades form turbodrill turbine stages in which the linear motion of the drilling fluid is transformed into the rotary motion of said rotors; means for fixing said stators and rotors of the turbine stages to said shaft and housing, respectively; the blades of said rotor and stator being shaped in such a manner that an angle ($\theta$) between tangents to a middle line of the profile of said blades at the inlet and outlet edge of said blades is determined by the relationship $\theta = 180° - (\text{from } 4.5 \text{ to } 7)\alpha_1$, wherein $\alpha_1$ is an angle between the line perpendicular to an axis of said blade patterns and the tangent to the middle line of profile of said blades at the inlet edge thereof, as measured in the direction towards the concave portion of the blade profile, and angle ($\alpha_2$) between a line perpendicular to the axis of said blade patterns and the tangent to the middle line of said blades at the outlet edge thereof is determined by the relationship $\alpha_2 = (\text{from } 3.5 \text{ to } 6)\alpha_1$, and the ratio of maximum thickness ("$\delta$") of the profile of said blades to the chord ("1") thereof is selected within the range $\delta/1 = \text{from } 0.9 \text{ to } 0.19$; a cage mounted below said thrust bearing comprising: a first shouldered bushing fixed to said shaft and provided with passages defining, together with said shaft, an annular space, and a second shouldered bushing accommodated in the annular space of said first bushing and fixed in said housing, the annular space communicating with the central passage of said shaft through the passages of said bushing.

3. The turbodrill as claimed in in claim 2 wherein the thrust bearing is mounted on an independent assembly spindle.

* * * * *